US007121966B2

(12) United States Patent
Fitzmaurice

(10) Patent No.: US 7,121,966 B2
(45) Date of Patent: Oct. 17, 2006

(54) APPARATUS AND METHOD FOR MANIPULATING A BALL

(76) Inventor: Devin Ian Fitzmaurice, 1599 Vista Del Valle, El Cajon, CA (US) 92019

( * ) Notice: Subject to any disclaimer, the term of this patent is extended or adjusted under 35 U.S.C. 154(b) by 85 days.

(21) Appl. No.: 10/730,352

(22) Filed: Dec. 8, 2003

(65) Prior Publication Data

US 2004/0116204 A1 Jun. 17, 2004

Related U.S. Application Data

(63) Continuation-in-part of application No. 09/965,470, filed on Sep. 27, 2001, now abandoned.

(51) Int. Cl.
*A63B 59/06* (2006.01)

(52) U.S. Cl. ..... 473/559

(58) Field of Classification Search ..... 473/286, 473/410, 412, 559, 327, 328
See application file for complete search history.

(56) References Cited

U.S. PATENT DOCUMENTS

| | | | | |
|---|---|---|---|---|
| 3,632,112 | A | 1/1972 | Jacobs | |
| 3,779,398 | A | 12/1973 | Hunter | |
| 4,065,133 | A | 12/1977 | Gordos | |
| 4,140,318 | A | 2/1979 | Izett et al. | |
| 4,165,076 | A | 8/1979 | Cella | |
| 4,248,430 | A | 2/1981 | Kepler | |
| 4,486,019 | A | 12/1984 | Sievers | |
| 4,580,784 | A | 4/1986 | Brill | |
| 4,934,702 | A | 6/1990 | Serizawa | |
| 5,014,992 | A | 5/1991 | McCallister | |
| 5,133,553 | A | 7/1992 | Divnick | |
| 5,137,275 | A | 8/1992 | Nelson | |
| 5,186,465 | A | 2/1993 | Chorne | |
| 5,310,189 | A | 5/1994 | Soto | |
| 5,441,264 | A | 8/1995 | Schmidt et al. | |
| 5,547,426 | A | 8/1996 | Wood | |
| 5,620,378 | A | 4/1997 | Fritz et al. | |
| 5,692,968 | A * | 12/1997 | Shine | 473/286 |
| 5,792,005 | A | 8/1998 | Sieleman et al. | |
| 6,257,991 | B1 | 7/2001 | Ortiz | |
| 6,322,457 | B1 | 11/2001 | Klein | |

* cited by examiner

*Primary Examiner*—Raeann Gorden
(74) *Attorney, Agent, or Firm*—Charles F. Reidelbach, Jr.

(57) ABSTRACT

A toy or game includes a head assembly having dimensions to provide a planar contact surface for the continuous bouncing of an elastomer ball off of the assembly surface. Located opposite the striking surface of the club head is a back surface that includes a concave pocket cavity that is large enough to hold at least one ball. The head assembly also has a bottom surface that is convex located adjacent to the back surface, and a hosel for attaching a shaft to the head assembly. The concave pocket and the oversized head allow a player to volley the ball, scoop the ball up or hit from a surface, and toss or catch the ball to/from another player.

6 Claims, 6 Drawing Sheets

APPARATUS AND METHOD FOR MANIPULATING A BALL

This application is a continuation-in-part of application Ser. No. 09/965,470, filed Sep. 27, 2001 now abandoned.

BACKGROUND OF THE INVENTION

This invention relates generally to games of skill requiring eye-hand coordination, and more specifically to a club-like apparatus for bouncing, throwing, catching and scooping one or more elastomer balls.

Both children and adults are attracted to games and sports that require or develop eye-hand coordination and which can be played either alone or in groups. One such game/sport is "foot bag," (e.g., Hacky Sack®) where a ball-like bean bag is bounced, tossed and caught using only the feet. Unfortunately, this activity requires a high degree of coordination and agility and it is difficult to master for most people. Young children are unlikely to have the necessary coordination and many adults are unlikely to have the necessary agility. Thus, their attempts to learn will often end in frustration and failure.

Another example of a difficult-to-master skill is one that has become popular with the rise of a well-known professional golfer. This golfer has the uncanny ability to scoop a golf ball from the ground with his golf club, and bounce and catch the ball on the face of the club, much as a skilled foot bag player can bounce and catch the foot bag on his foot. He regularly entertains his fans with demonstrations of this skill, and many fans would like to emulate this skill, even if they have no interest in playing golf. However, it is too difficult for most of them.

Therefore, a need exists for an apparatus that can be used by both children and adults that facilitates the development of the coordination and agility that are required to perform these and other similar activities.

SUMMARY OF THE INVENTION

The present invention is a club-like apparatus which includes a head assembly attached to a shaft with a gripping surface at the opposite end. Preferably, the present invention is manufactured from molded plastic, but it may also be manufactured from other materials such as metal, fiberglass, foam plastics, etc., alone or in combination. The grip of the present invention may be is a foam-rubber sleeve or other suitable material which provides a cushioned, non-slip gripping surface. Alternatively, the gripping surface may be molded as part of the shaft. The head assembly of the present invention includes a face, a bottom surface or sole, and a back surface containing a pocket cavity.

The face, which is used for scooping or bouncing an elastomer ball approximately the size of a golf ball, is flat (i.e., paddle-like) to facilitate control of the ball as it is bounced on the head assembly. The ball may be manufactured from any type of material which exhibits elastic or resilient characterization, such as a foam plastic, soft rubber, etc. In addition, the face is dimensioned much larger than the ball to make it easy for the user to consistently and continuously bounce the ball on the face. A foam-like contact pad may be attached to the face for cushioning the impact of a ball, and for providing more control in launching or catching a ball. The face is highly angled with respect to the longitudinal axis of the shaft so as to facilitate the scooping of a ball from the ground when the bottom surface of the head assembly is placed on the ground. By angling the shaft, the face may be brought parallel to the ground to provide a surface substantially perpendicular to a continuous vertical bouncing of a ball.

The back surface or back face of the head assembly contains a pocket cavity that can hold at least one elastomer ball. The uniquely designed pocket cavity has different regions that allow a user to perform different actions. One region allows a user to loosely contain a ball such that the ball can be scooped, caught or tossed and thereby transferred either to or from an object, such as a wall or other rebounding surface, or to or from another player who is using the same or similar apparatus. Another region of the pocket cavity allows a user to securely hold a ball and thereby store the ball when the apparatus is not in active use.

The shaft of the present invention is adjustable and may be sized to the user by, for example, removing a section of the shaft, or by telescoping the shaft to a preferred length.

The bottom surface of the head assembly connects the back surface to the face. In the present invention, the bottom surface is convex in shape, but may be of many different shapes. The convex shape of the bottom surface is constructed to include fins which are spaced at a distance from each other. Alternatively, the convex surface can have a continuous shaped surface that is void of any spaces. However, a fin-type structure of the bottom surface of the head assembly has several advantages including a savings in material cost, a reduction in weight of the apparatus, and an aid in the manufacturing process. The fin design requires less material resulting in a reduction of material cost and weight. A lighter head assembly also allows a user to manipulate the apparatus with less effort and less fatigue. This feature is particularly helpful for young children who may have significantly less arm strength than an adult. Another advantage of the fin-shaped bottom surface is evident in the manufacturing process. For head assemblies molded from a plastic, or a similar material, the fins reduce the time required for material cooling. In addition, because the material sets faster, the head assembly may be removed from a mold more quickly to reduce the time for manufacture of each assembly. In addition to the above advantages, the curvature of the bottom surface also allows the head assembly to roll on a surface to facilitate in the scooping of a ball from that surface.

The present invention offers multiple modes of play not available together in any single toy, game or piece of sports equipment. Because of the uniquely designed face and pocket cavity of the apparatus, a broad range of games may be played with the present invention, and new games may be devised which combine elements of many games. For example, the pocket cavity may be used like a lacrosse stick to scoop, carry, toss and catch a ball. At the same time, the oversized face of the apparatus may be used like a club or bat to strike a ball while it is airborne, or to scoop, carry or bounce a ball while the user runs or walks with the apparatus.

One method of using the present invention allows an individual player to volley and catch a ball. The method begins with the user collecting or scooping a ball into a region of the pocket cavity which is wider than the ball and that allows the ball to move freely in and out of the pocket cavity. The ball may be collected into the pocket cavity either by scooping the ball directly off of the ground/floor or by catching the ball from the air. The ball is then transferred from the pocket cavity onto the face by tossing the ball in the air from the pocket cavity. The player may bounce the ball continuously on the face so that the ball remains airborne.

The player may also alternate bouncing the ball off of the face and catching the ball into the pocket cavity.

Another method of using the present invention is use by more than one player in a volley-type of a game. In this method, the ball is scooped up and then volleyed onto the face of a first player's apparatus. The ball is tossed to another player for volleying and/or for passing. The object of the game is to catch and volley a ball between players and to keep the ball airborne for as long as possible. By practicing the methods of the present invention, players can compete against one another or can play by themselves to develop tricks and games and to improve their coordination and skills. Individual or group playing or practicing aids in the development of a user's balance, hand and eye coordination, and concentration skills.

Accordingly, it is an object of the present invention to provide an apparatus for both children and adults that may be used for performing and practicing tricks that normally only highly coordinated or athletic persons are able to perform and for developing coordination skills.

It is another object of the present invention to provide a method wherein one or more persons may develop skills and coordination in scooping, bouncing, tossing and catching a ball with a club-like apparatus that can be used like a foot in a game of Hacky Sack® or to emulate or combine the activities of multiple games or sports.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE INVENTION

Figure 4:
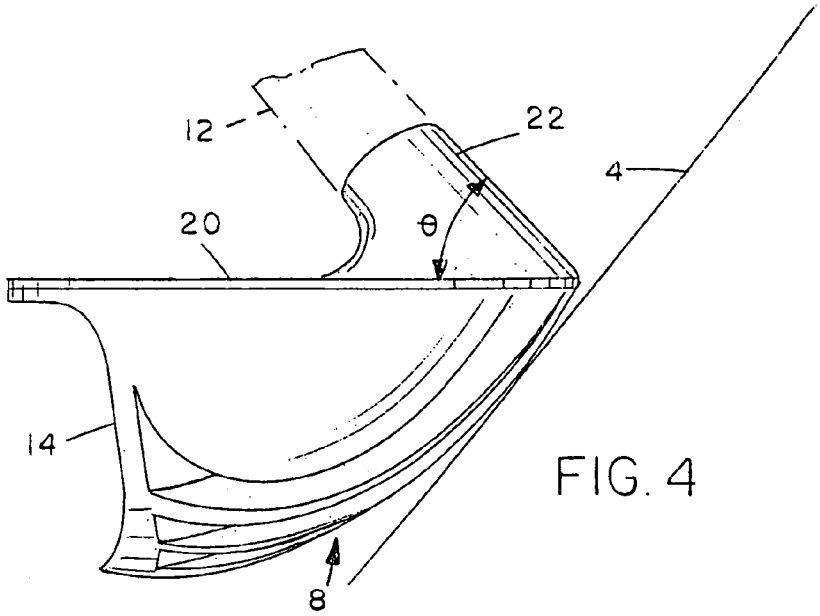
FIG. 4 is an end view taken from the right-hand side of FIG. 1.
Figure 5:
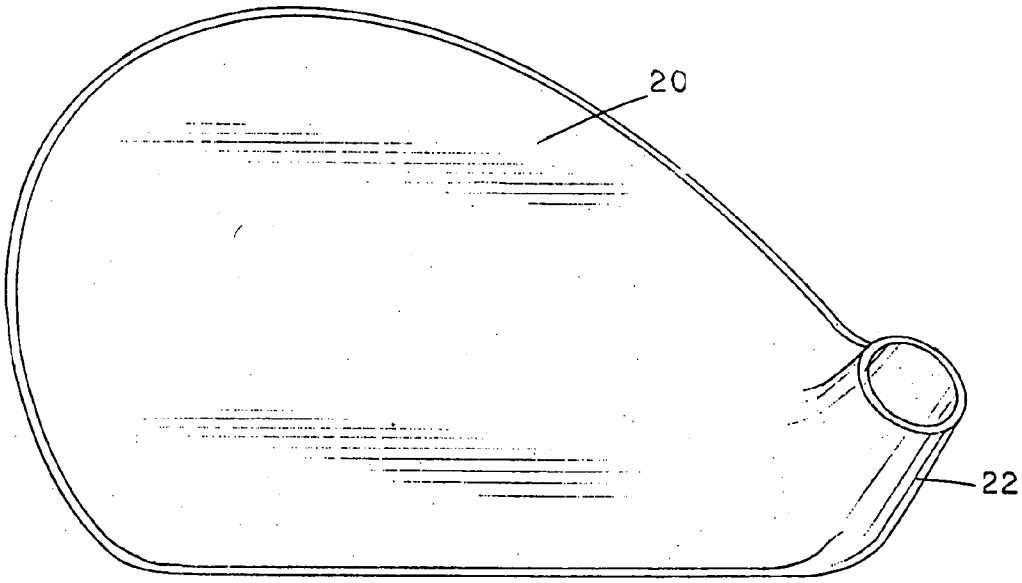
FIG. 5 is a top view of the face of the head assembly.

FIGS. 1 to 9 illustrate various views of a preferred embodiment of the apparatus of the present invention. The apparatus includes a club-shaped head assembly 10 attached to a shaft 12 at a hozel 22 using any conventional means for attachment. The shaft 12 of the preferred embodiment has a grip 13 formed thereon and is adjustable and/or may be sized to the player by, for example, removing a section of the shaft 12, or by telescoping the shaft 12 to a preferred length. The assembly 10 has a face 20 for contacting or striking an elastomer ball (not shown). The ball 100 may be manufactured from any type of material having elastic or resilient characteristics, such as foam plastic, soft rubber, etc. The face 20 is a generally planar surface as shown in FIG. 5. The face 20 of the preferred embodiment has a surface area much greater than the diameter of the ball to provide a user with a larger area in which to contact the ball. The expanded face 20 provides a paddle-like target for a player to volley and/or bounce a ball continuously on the face 20. Referring to FIG. 4, the face 20 is angled θ with respect to the shaft 12 to provide a loft angle when the bottom surface or sole 8 of the head assembly 10 is placed on the ground surface 4. In the preferred embodiment, the angle θ is 60 degrees, but may be manufactured to have any desired angle θ which facilitates scooping a ball from the ground and bouncing a ball on the face 20.

Figure 1:
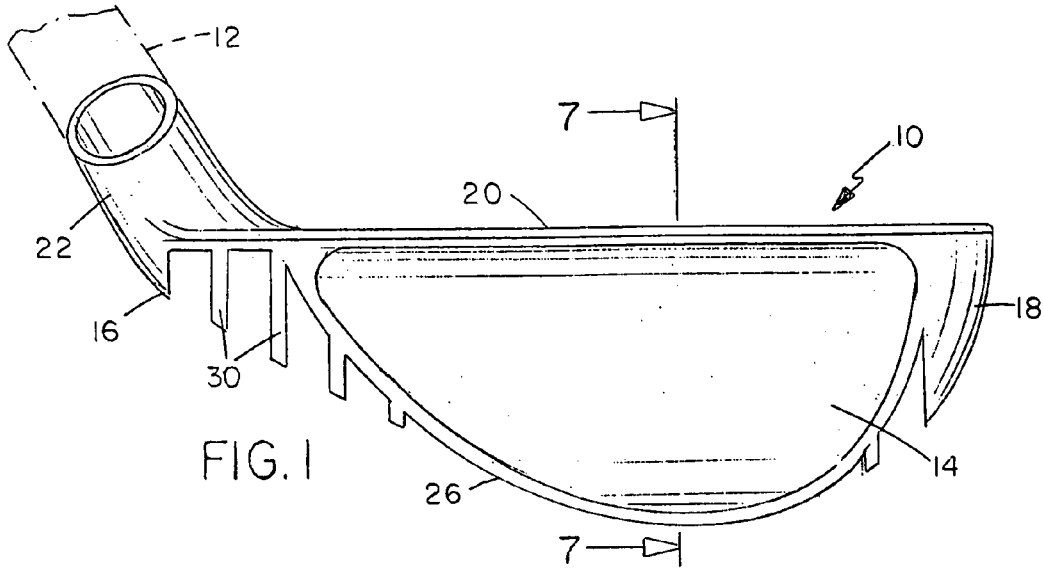
FIG. 1 is a view of the back surface of the head assembly.
Figure 2:
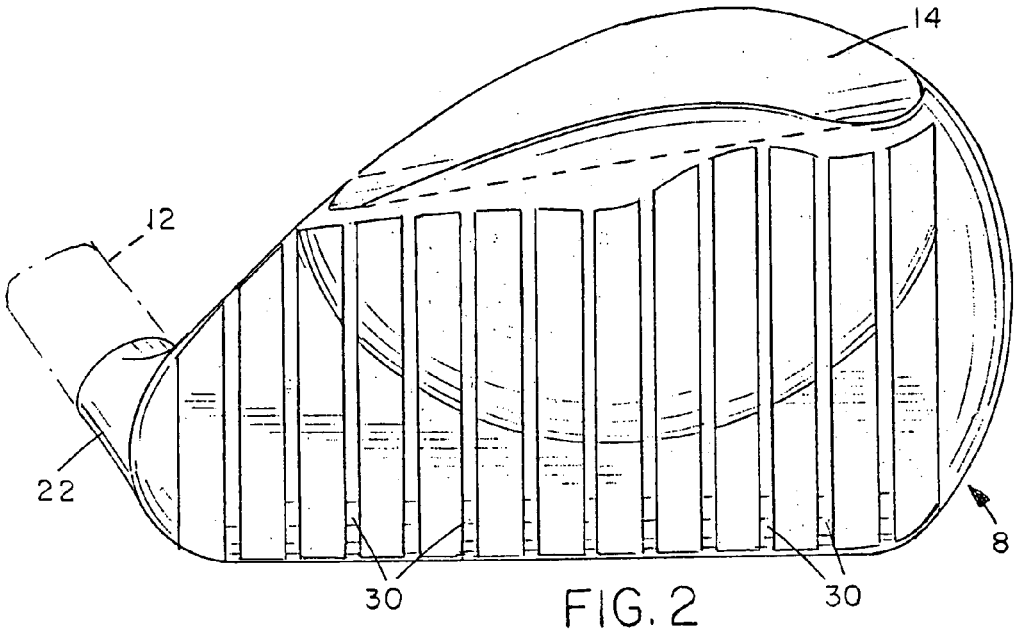
FIG. 2 is a bottom view of the bottom surface of the head assembly.
Figure 3:
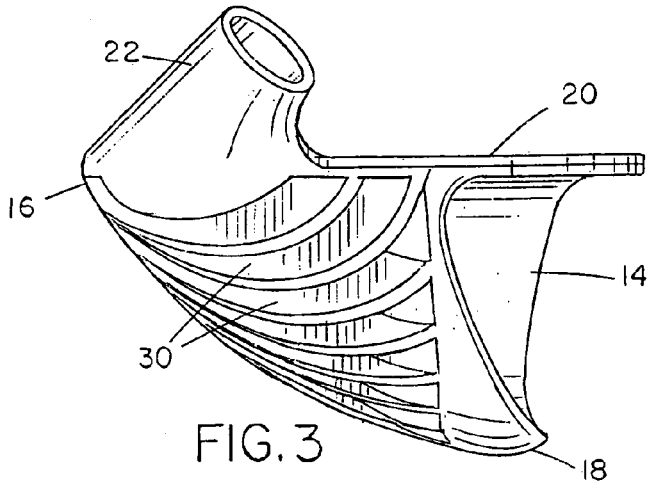
FIG. 3 is an end view taken from the left-hand side of FIG. 1.
Figure 7:
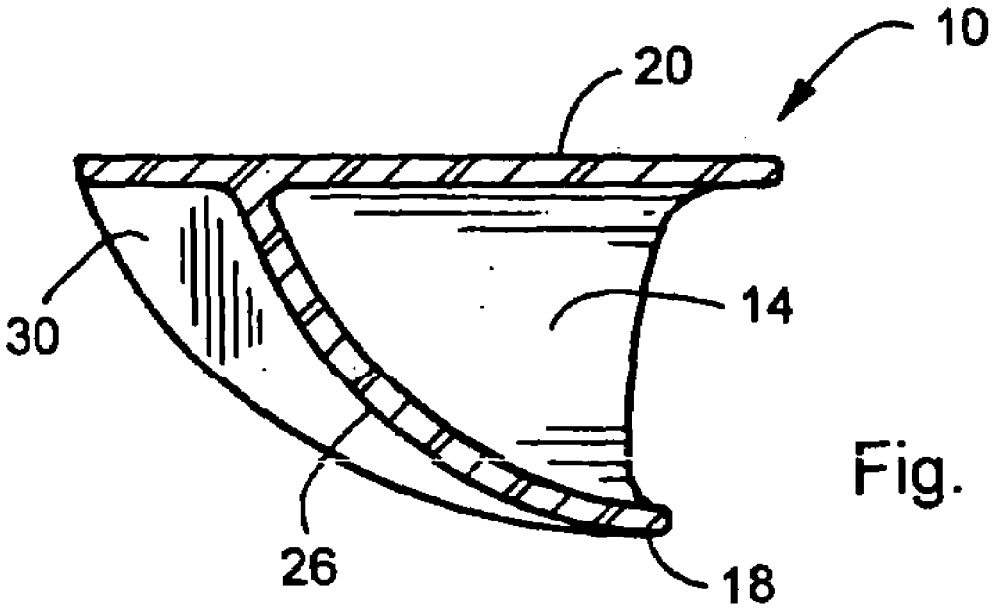
FIG. 7 is a sectional view taken on line 7—7 of FIG. 1.
Figure 7A:
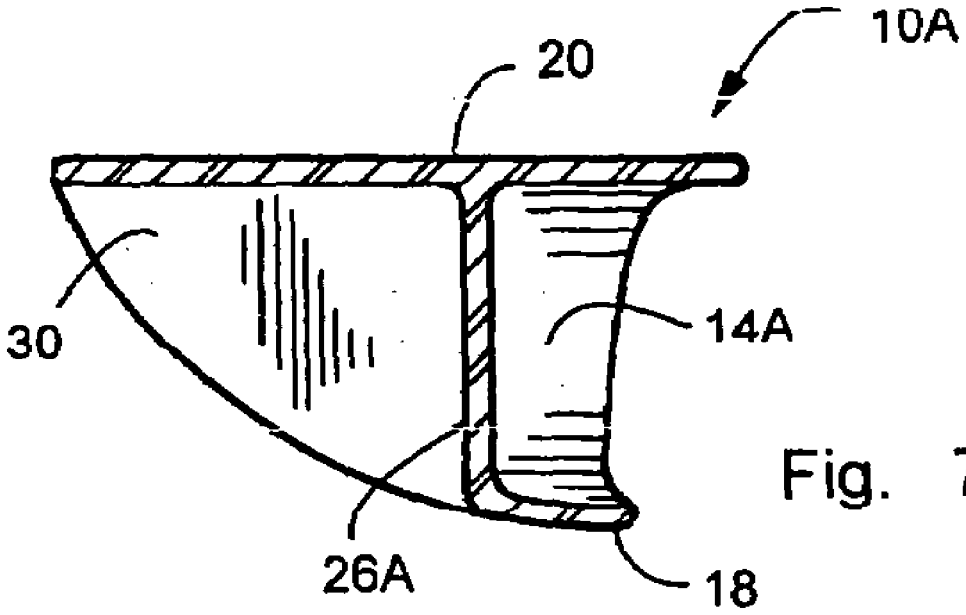
FIG. 7A is a sectional view taken on line 7—7 of FIG. 1 showing an alternative embodiment with a flat bottom cavity.
Figure 10:
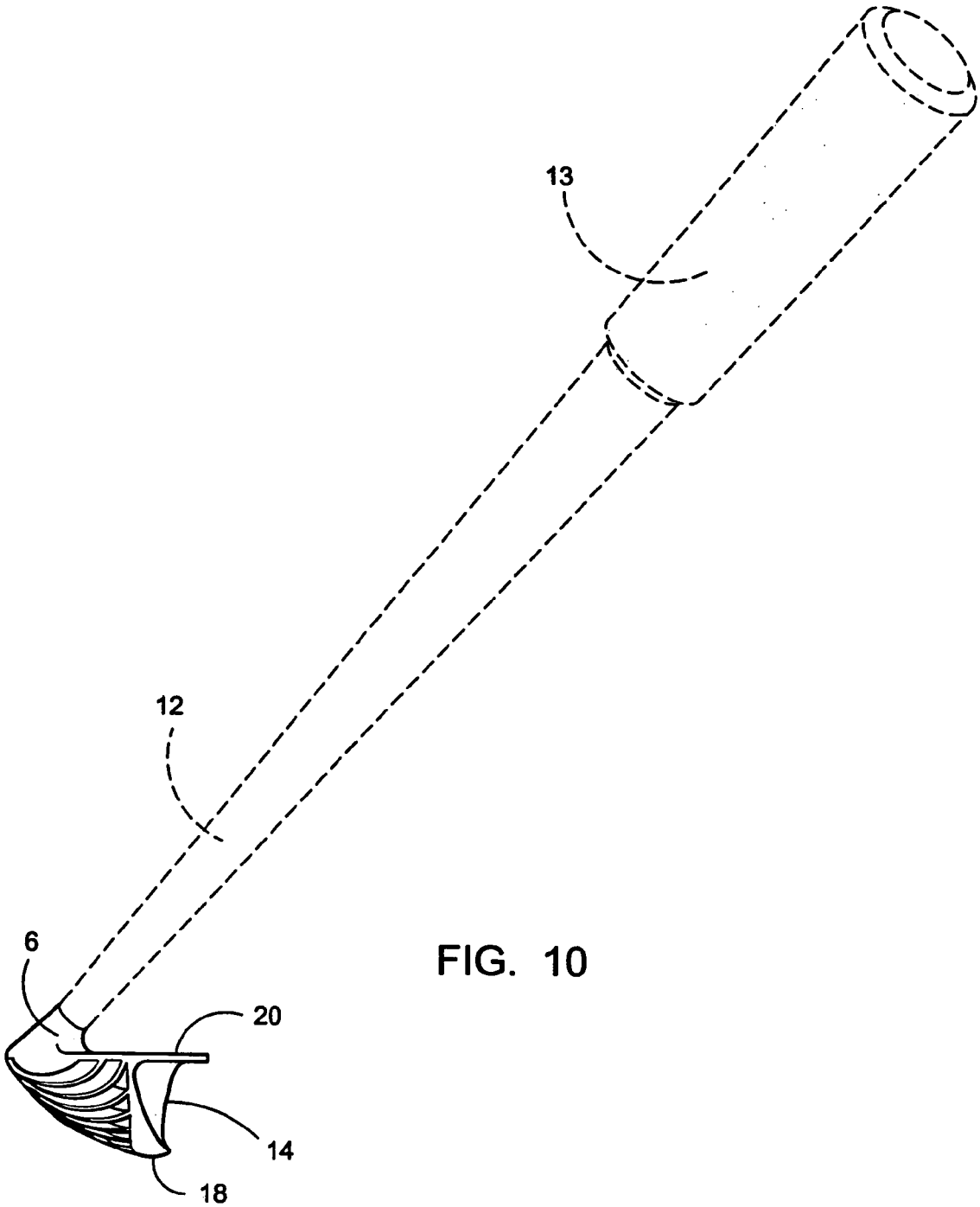
FIG. 10 illustrates a club shaped head assembly attached to a shaft 12 and having a grip 13 formed thereon.
Figure 11:
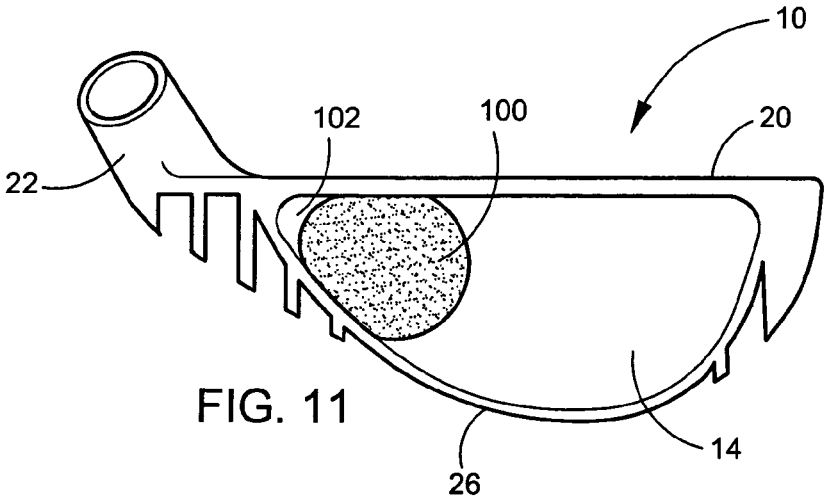
FIG. 11 is a view of the back surface of the head assembly showing the ball 100 compressed between the side walls in region 102.
Figure 12:
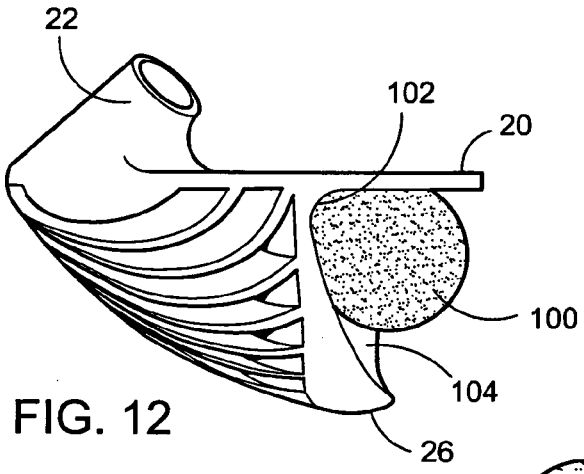
FIG. 12 is an end view taken from the left hand side of FIG. 11.
Figure 13:
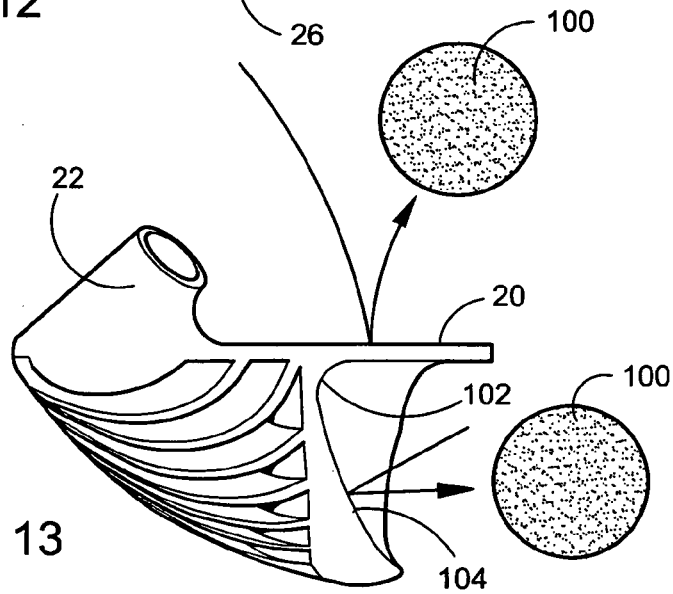
FIG. 13 is an end view taken from the left hand side of FIG. 11 showing the ball 100 moving freely in region 104.

Continuing with FIG. 1, the head assembly 10 has a back surface 26, that is connected to the face 20 by the bottom surface 8, and which contains a pocket cavity 14. Referring also to FIGS. 7 and 7A, the pocket cavity 14, 14A of the preferred embodiment may have a concave or curved recess 26 or a substantially flat bottom 26A with sidewalls which are substantially perpendicular to the flat bottom 26A. The pocket cavity 14 of the preferred embodiment is at least as deep as the radius of the ball and may be deeper than the diameter of the ball. Referring again to FIG. 1, the unique shape of the pocket cavity 14 is defined by the contours of its inner sidewalls. One inner sidewall has a substantially flat contour which is approximately parallel with the face 20. The other inner 26 sidewall has a curvilinear contour. Together, the sidewalls create regions of pocket cavity 14 that have different sidewall spacings. In one region of pocket cavity 14, designated as 104 in FIGS. 11 and 12, the sidewalls are spaced farther apart than the diameter of the elastomer ball 100, allowing the ball 100 to move freely into and out of the pocket cavity 14 so that the ball 100 may be scooped from the ground, caught, carried or thrown from the pocket cavity by a user of the apparatus. The cross-section of FIGS. 7 and 7A are taken through the region of the pocket cavity where the sidewalls are spaced farther apart than the diameter of the elastomer ball 100. In another region of pocket cavity 14, designated as 102 in FIGS. 10–12, the sidewalls are spaced less than the diameter of the elastomer ball 100, allowing the ball 100 to be compressed between the sidewalls so that the ball may be stored in the pocket cavity when the apparatus is not in use.

The bottom surface 8 of the head assembly 10 of the preferred embodiment is convex to allow a user to roll the head assembly 10 in order to scoop balls up from the ground 4. However, in other configurations of the present invention, the bottom surface 8 may have other shapes. The convex shape of the bottom surface 8 of the preferred embodiment includes fins 30 that are spaced apart along the bottom surface 8 of the head assembly 10. The use of fins 30 also results in a lighter head assembly 10 that is easier to control.

Figure 6:
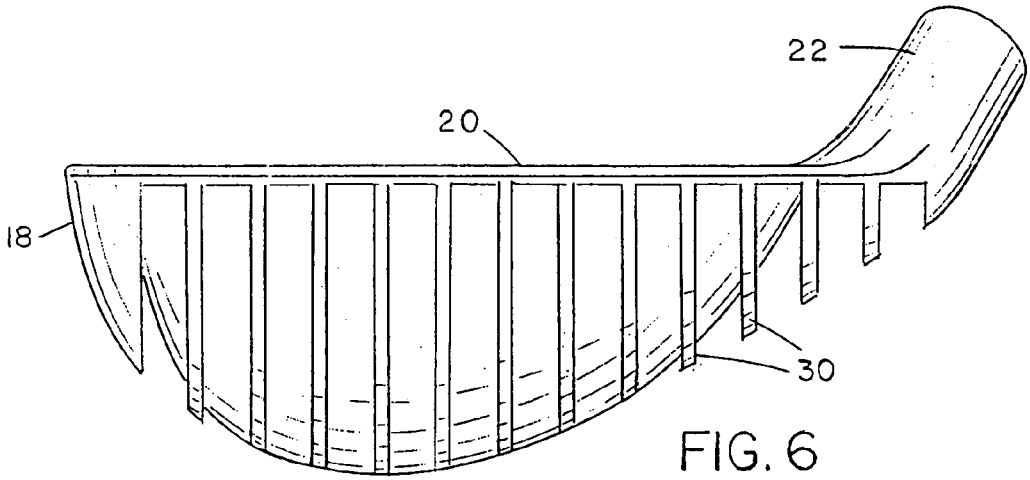
FIG. 6 is a rear view thereof.

In addition, the manufacturing process time is reduced for assemblies made of plastics since the head assembly 10 sets quicker in the mold injection process. And as shown in FIG. 6, the depth of a fin 30 provides greater surface area for the quick cooling of the plastic used to manufacture the head assembly 10. In other embodiments of the present invention, the convex head 10 can have a continuous shaped surface that is void of any spaces.

Figure 8:
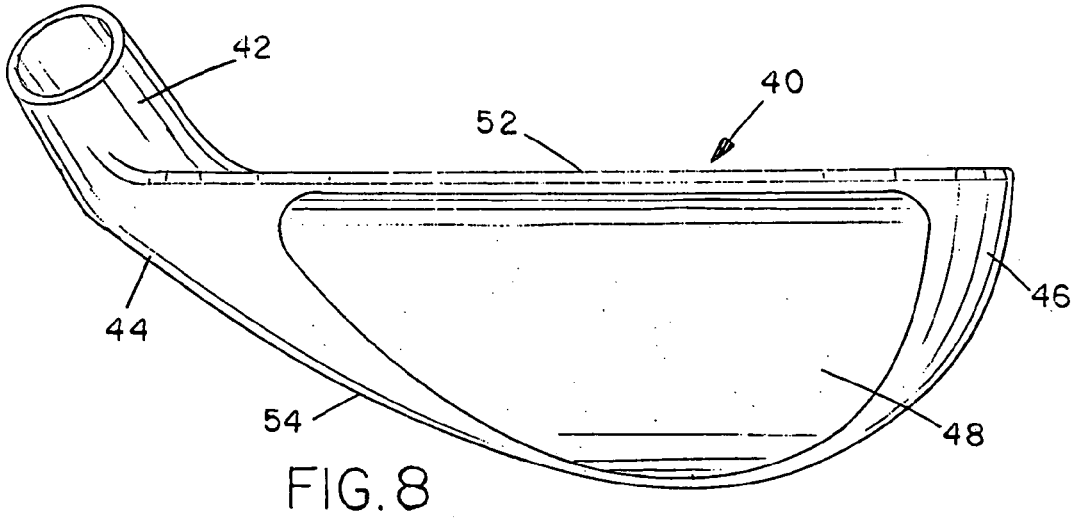
FIG. 8 is a view of the back surface of a head assembly without the fin structure.
Figure 9:
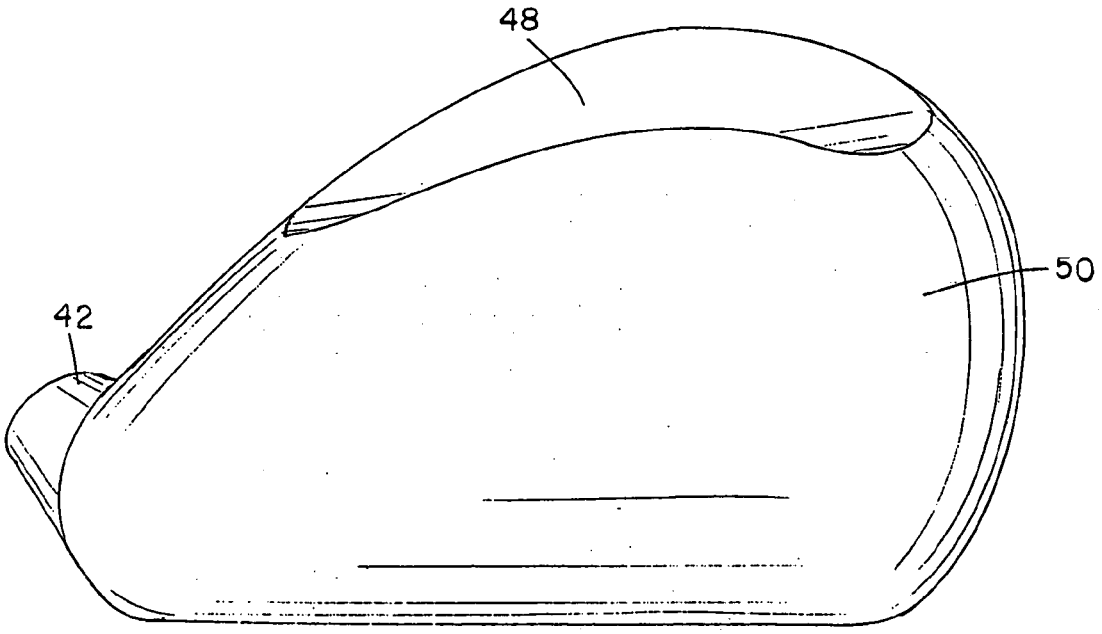
FIG. 9 is a bottom plan view of the configuration of FIG. 8.

FIGS. 8 and 9 illustrate an alternate head assembly 40 of the present invention. The head assembly 40 includes a face 52, a back surface 54 that contains a pocket cavity 48, a heel 44, a toe 46, and a hosel 42. As shown in FIG. 9, the bottom surface or sole 8 of the alternate embodiment is a convex, continuous surface that does not include fins. A person skilled in the art will recognize that the head assembly of the alternate embodiment 40 may be configured in a number of shapes. In addition, any suitable light weight material such as plastic or fiberglass, or combinations thereof, may be used to form the head assembly 10 and shaft 12 of any of the embodiments. For example, the toy of an embodiment may include a foam-like contact pad (not shown) attached to the club face 52 for blunting the impact of a ball, and for providing more control in launching or catching a ball.

Although exemplary embodiments of the invention have been described herein in detail it will be understood by those skilled in the art that variations may be made to the disclosed embodiments without departing from the spirit of the invention, or the scope of the appended claims.

The invention claimed is:

1. An apparatus for manipulating an elastomer ball, comprising:

an elongate shaft having a grip end and a lower end; and a head assembly affixed to the lower end of the shaft, the head assembly comprising:

a face having a generally planar surface at an angle with respect to the shaft for striking the ball;

a back surface adjacent the face, the back surface having an opening to a pocket cavity; and the pocket cavity formed within an interior region defined by the face, the back surface, and a bottom portion connecting the face to the back surface, the pocket cavity having a first region for securely storing the ball, and a second region for at least one or catching, scooping up, and tossing the ball.

2. The apparatus of claim 1, wherein the angle is 60 degrees.

3. An apparatus for striking, scooping, tossing and storing an elastomer ball, the apparatus comprising:

a shaft having a first end for gripping of the apparatus;

a striking head attached to a second end of the shaft, the striking head including:

a striking surface positioned at an angle with respect to the shaft, wherein the striking surface is substantially parallel to a horizontal ground plane;

a back surface adjacent the striking surface, the back surface comprising an opening to a pocket;

a bottom surface connecting the striking surface to the back surface; and the pocket forming an enclosed area defined by a region between the striking surface, the back surface and the bottom surface, the pocket accessible through the opening in the back surface, and the pocket having a first region for securely storing the ball, and a second region for loosely carrying the ball.

4. The apparatus as in claim 3, wherein the shaft further comprises a hinging point for adjusting the angle of the striking surface.

5. An apparatus for manipulating an elastomer ball, comprising:

an elongate shaft having a longitudinal axis, a proximal end and a distal end;

a gripping surface at the proximal end of the elongate shaft;

a head assembly fixedly attached to the distal end of the elongate shaft, the head assembly comprising:

a face adapted for bouncing the elastomer ball in a substantially vertical direction, the face comprising a substantially planar surface at an angle with respect to the longitudinal axis of the elongate shaft;

a back surface, positioned adjacent the face and a bottom surface, containing a cavity of substantially constant depth at least as great as the radius of the elastomer ball, the cavity adapted for at least one of catching, scooping, tossing and storing the elastomer ball, the cavity comprising:

a substantially flat cavity bottom;

a substantially flat sidewall portion approximately perpendicular to the cavity bottom; and a curvilinear sidewall portion approximately perpendicular to the cavity bottom, wherein the curvilinear sidewall portion defines a first and second region, the first region adapted for at least one of catching, scooping and tossing the elastomer ball, wherein the distance between the substantially flat sidewall portion and the curvilinear sidewall portion is greater than the diameter of the elastomer ball; and the second region, adjacent to the first region, adapted for storing the elastomer ball, wherein the distance between the substantially flat sidewall portion and the curvilinear sidewall portion is less than the diameter of the elastomer ball.

6. The apparatus as in claim 5, wherein the first region is contiguous with the second region.

* * * * *